US007232131B2

(12) United States Patent
Hurst

(10) Patent No.: US 7,232,131 B2
(45) Date of Patent: Jun. 19, 2007

(54) SKATE APPARATUS

(75) Inventor: Malcolm Paul Hurst, Queensland (AU)

(73) Assignee: Australian Retractable Blades Pty Ltd, Queensland (AU)

( * ) Notice: Subject to any disclaimer, the term of this patent is extended or adjusted under 35 U.S.C. 154(b) by 119 days.

(21) Appl. No.: 10/490,929

(22) PCT Filed: Oct. 7, 2002

(86) PCT No.: PCT/AU02/01359

§ 371 (c)(1),
(2), (4) Date: Mar. 26, 2004

(87) PCT Pub. No.: WO03/031002

PCT Pub. Date: Apr. 17, 2003

(65) Prior Publication Data

US 2005/0001390 A1 Jan. 6, 2005

(30) Foreign Application Priority Data

Oct. 5, 2001 (AU) ..... PR8104
Sep. 11, 2002 (AU) ..... 2002951325

(51) Int. Cl.
*A63C 17/06* (2006.01)

(52) U.S. Cl. ..... 280/11.27; 280/7.13; 36/115

(58) Field of Classification Search ..... 280/11.27, 280/11.3, 7.13, 811, 825, 11.31, 11.32, 11.33; 36/115; 292/177, DIG. 61
See application file for complete search history.

(56) References Cited

U.S. PATENT DOCUMENTS

| | | | | |
|---|---|---|---|---|
| 426,844 | A * | 4/1890 | Murray et al. | 292/42 |
| 1,180,943 | A * | 4/1916 | Prazmo | 292/163 |
| 4,928,982 | A * | 5/1990 | Logan | 280/11.224 |
| 5,803,469 | A | 9/1998 | Yoham | |

FOREIGN PATENT DOCUMENTS

| | | | |
|---|---|---|---|
| DE | 29717652 | U1 * | 11/1997 |
| DE | 297 17 652 | U1 | 1/1998 |
| DE | 201 02 447 | U1 | 6/2001 |
| FR | 2 780 896 | A1 | 1/2000 |
| WO | WO 03/031002 | A1 | 4/2003 |

* cited by examiner

*Primary Examiner*—Christopher P. Ellis
*Assistant Examiner*—John Walters
(74) *Attorney, Agent, or Firm*—Tarolli, Sundheim, Covell & Tummino LLP

(57) ABSTRACT

A displacement apparatus is provide for skating footwear such as in-line roller skates. The displacement apparatus has extension triggers, each of which is connected to respective rod members that releasably retain the rollers in a retracted position, and a retraction trigger connected to a slidable rod member that releasably retains the rollers in an extended position. Manual operation of the extension triggers and retraction trigger allows extension or retraction of the in line rollers as required. When retracted, the rollers are conveniently housed within a cavity in the underside of the shoe to thereby allow normal walking.

13 Claims, 5 Drawing Sheets

SKATE APPARATUS

FIELD OF THE INVENTION

THIS INVENTION relates to a displacement apparatus applicable to skating footwear. More particularly, this invention relates to an apparatus for retracting and extending one or more rollers, wheels or blades into a cavity within the sole of a skating shoe, without being limited thereto. This invention enables a wearer of skates to retract or extend the rollers, wheels or blades, thereby allowing normal walking use or skating use of the shoe as required.

BACKGROUND OF THE INVENTION

Recreational and sporting footwear such as roller skates, ice skates, rollerblades and the like are well known. It has also been known to create footwear which can function both as a skate and as a shoe suitable for walking without impediment by the skate. To this end, skating footwear have been developed whereby the rollers or skates are displaceable between a ground-engaging, extended position for skating or rollerblading, and a retracted position which allows normal walking.

Typically, footwear incorporating a retractable skate have a recess or cavity in the underside or sole of the footwear which houses the skate when retracted. Retraction of the skate into the recess, and extension out of the recess into a ground-engaging position, enable selection of normal walking use or skating use respectively.

Skating footwear having retractable and/or extendible skating means are variously described, for example, in International Publication WO 01/85271, International Publication WO 00/16862 and U.S. Pat. No. 5,803,469

However, many such displacement apparatus for skating footwear are cumbersome to operate, difficult and costly to manufacture and are prone to inadvertent retraction of the skating means during skating use. This latter problem can lead to a skater being injured. The general acceptability and commercial appeal of skating footwear of the type hereinbefore described has been compromised by some of all of the aforementioned deficiencies.

OBJECT OF THE INVENTION

The present inventor has sought to overcome the generally cumbersome and complicated apparatus of the prior art by inventing a simple, easy to use and safe apparatus for displacing rollers, wheels or skates of skating footwear from a retracted position to an extended position, and vice versa.

It is therefore an object of the invention to provide a displacement apparatus for skating footwear that overcomes one or more problems or deficiencies of the prior art, or at least provides a useful and commercially attractive alternative.

SUMMARY OF THE INVENTION

In one aspect, the present invention provides a displacement apparatus for footwear having a skating means, said displacement apparatus comprising an actuating means operable to initiate pivotal displacement of said skating means, wherein said actuating means comprises one or more retraction triggers and one or more extension triggers each of which is connected to one or more respective rod members that are each engageable with a mounting means that is mountable to an underside of said footwear.

In another aspect, the invention provides skating footwear comprising the displacement apparatus of the first-mentioned aspect.

Suitably, said actuating means is operable to initiate pivotal retraction of said skating means into a normal walking position, and is operable to initiate pivotal extension of said skating means into a ground-engaging position.

Preferably, said actuating means comprises first and second retraction triggers.

Preferably, said actuating means comprises an extension trigger.

Preferably, said actuating means is located in an underside of said footwear.

Preferably, the actuating means comprises one or more slidable rods, push-buttons or push-rods, levers, ring-pulls, pulleys, cables or the like to facilitate manual operation of said actuating means.

The skating means may comprise one or more wheels or rollers. The wheels or rollers may be "in-line", such as an in-line roller shoe or rollerblades, or may be in pairs mounted to a common axle, such as in traditional roller skates.

Another skating means contemplated by the present invention is a blade, such as used in ice skates.

Suitably, the skating means is pivotally attached to the footwear.

Preferably, the skating means is pivotally attached to the footwear by way of a carriage to which the rollers, wheels or blade is/are mounted.

Preferably, the displacement apparatus mounting means is a frame, bracket, brace or the like which is mountable to the underside of the shoe. In such a case, the carriage is pivotally-attached to said mounting means.

When retracted, said frame and wheels are housed at least partly within an extended portion or housing in the underside of said footwear, such as described in International Publication WO 01/85271, which is incorporated herein by reference in its entirety.

The present invention therefore provides displacement of said skating means by way of a relatively simple, safe, efficient and easy to use apparatus readily adaptable to any kind of skating footwear.

Throughout this specification, unless otherwise indicated, "comprise", "comprises" and "comprising" are used inclusively rather than exclusively, so that a stated integer or group of integers may include one or more other non-stated integers or groups of integers.

DETAILED DESCRIPTION OF THE INVENTION

Figure 1:
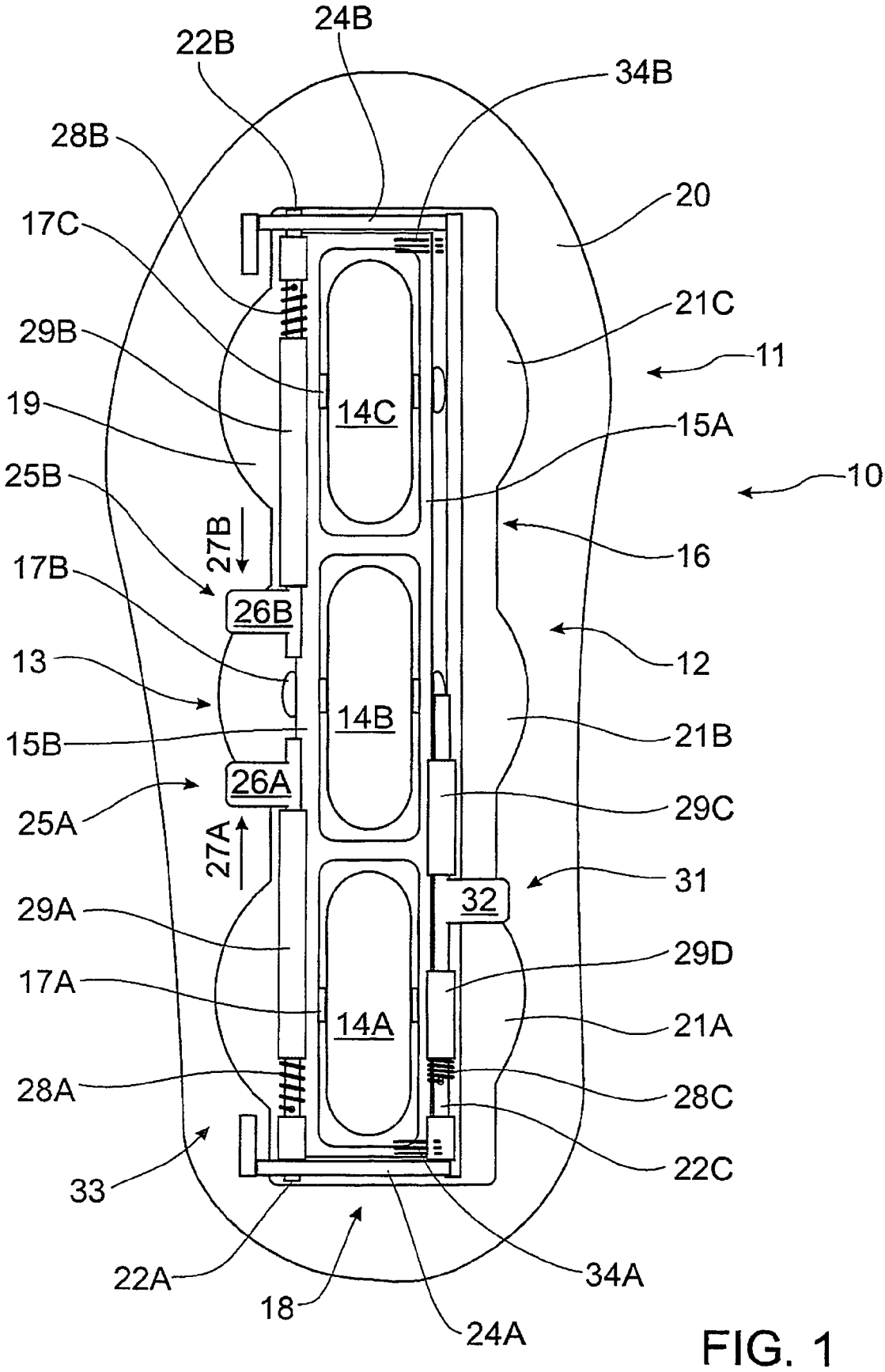
FIG. 1 shows a bottom plan view of a skating shoe with skating means in an extended position.

Referring to an embodiment shown in FIG. 1, skating footwear 10, in the form of an in-line roller shoe, comprises shoe 11 and displacement apparatus 12. Skating means 13 has three in-line wheels 14 A, B and C which are rotatably mounted to parallel members 15A and 15B of carriage 16 of displacement apparatus 12 via axles 17A, 17B and 17C respectively. Displacement apparatus 12 further comprises bracket 18 which is fitted into cavity 19 in underside 20 of shoe 11. Shoe underside 20 also includes scallops 21A, 21B and 21C into which wheels 14 A, B and C fit when retracted as in FIG. 3. As for example described in International Publication WO 01/85271, shoe underside 20 has an extension or housing projecting therefrom that provides a walking surface when skating means 13 is retracted.

Displacement apparatus 12 has an actuating means 33 comprising respective first and second retraction triggers 25A, 25B and extension trigger 31 that are manually operable to initiate pivotal displacement of skating means 13.

In the extended position shown in FIG. 1, first and second rods 22A, 22B extend into respective first and second apertures 23A, 23B located in end plates 24A, 24B of bracket 18 to assist maintenance of extended skating means 13. First and second retraction triggers 25A, 25B include tabs 26A, 26B that are respectively connected to first and second slidable rods 22A, 22B. To initiate retraction of skating means 13, first and second retraction triggers 25A, 25B are moved in the direction of arrows 27A, 27B by manual grasping of tabs 26A, 26B. This opposed, slidable movement of rods 22A, 22B is against the action of springs 28A, 28B that are mounted to first and second rods 22A, 22B respectively and bear against respective collars 29A, 29B. In this position, tab 32 of extension trigger 31 bears against collar 29C.

Figure 2A:
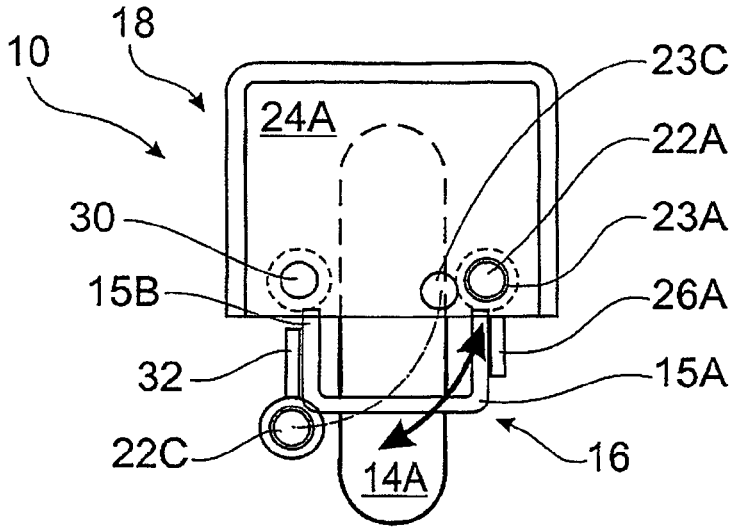
FIG. 2A shows a rear elevation schematic of a skating means in an extended position.
Figure 2B:
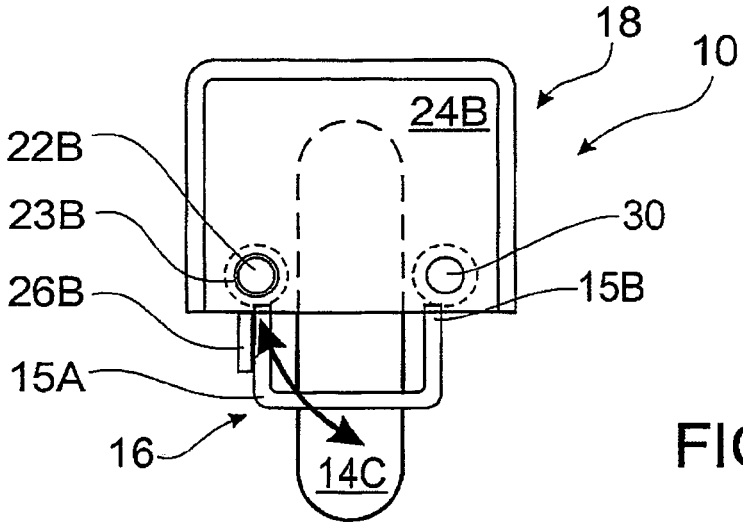
FIG. 2B shows a front elevation schematic of a skating means in an extended position.
Figure 2C:
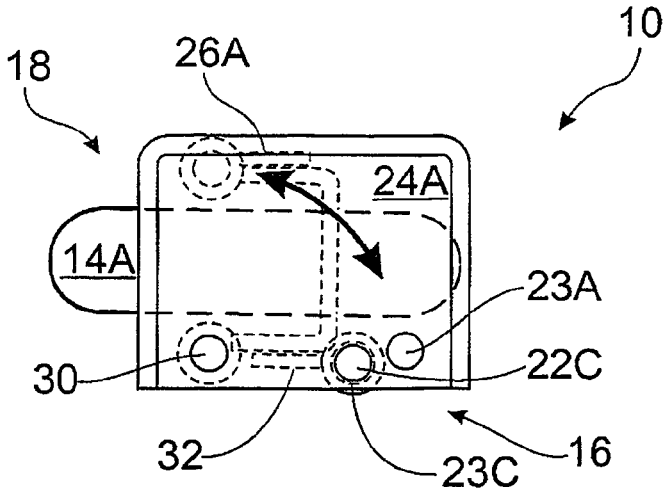
FIG. 2C shows a rear elevation schematic of a skating means in a retracted position.

As best seen in FIGS. 2A and 2B, carriage 16 pivots about pin 30 that extends between end plates 24A, 24B of bracket 18. Thus carriage 16 and wheels 14A, 14B and 14C mounted thereto are capable of pivotal movement relative to stationary bracket 18. During retraction, carriage 16 and skating means 13 mounted thereto rotate into cavity 19 into a retracted position such as shown in FIG. 1. Third rod 23C moves pivotally along the path indicated by the solid arrows in FIGS. 2A and 2B.

Figure 3:
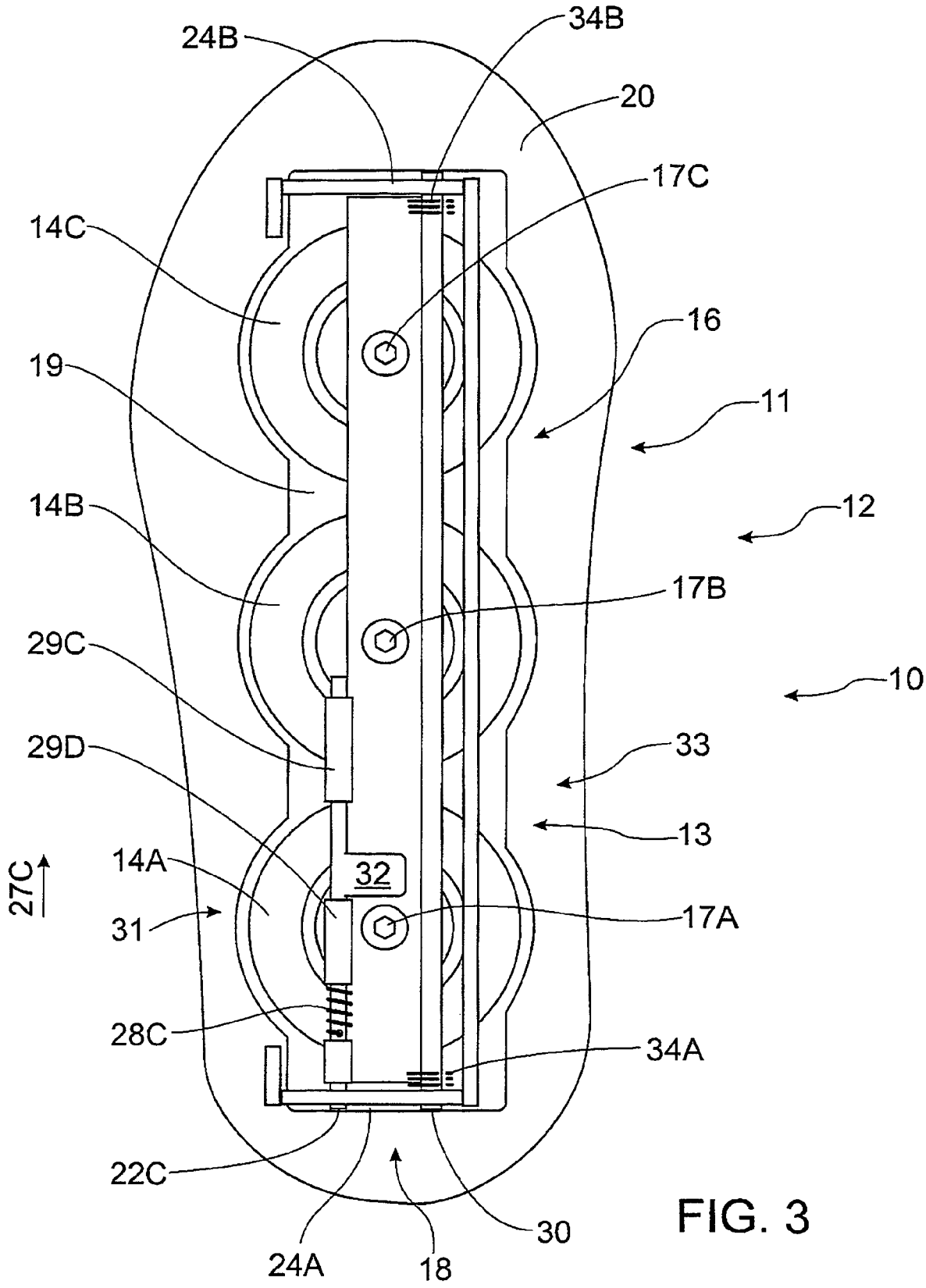
FIG. 3 shows a bottom plan view of a skating shoe with skating means in a retracted position.

Referring now to FIG. 3, to complete retraction of skating means 13, third rod 22C extends into third aperture 23C of bracket 18 assisted by spring 28C that bears against collar 29D. Third rod 22C thereby assists maintenance of skating means 13 in the retracted position shown in FIG. 3.

To initiate extension of skating means 13, extension trigger 31 comprising tab 32 connected to third rod 22C is moved in the direction of arrow 27C so that third rod 22C is disengaged from aperture 23C. Carriage 16 is then rotated out of cavity 19 in underside 20 of shoe 11 to the extended position shown in FIG. 1 and FIG. 2A. As best seen in FIG. 1, springs 28A and 28B respectively act to assist extension of first and second rods 22A, 22B into respective first and second apertures 23A, 23B in bracket 18 to assist maintenance of skating means 13 in an extended position. Extension of skating means 13 is assisted by hairpin springs 34A, 34B.

It will be appreciated that tabs 26A, 26B, and 32 provide a means whereby respective retraction triggers 25A, 25B and extension trigger 31 can be readily grasped for manual operation such as between a thumb and forefinger. However, the skilled person will realize that a variety of other graspable means could be used such as rings, hooks, blocks or pads with indents or surface contouring that allow grasping for manual operation.

Figure 4:
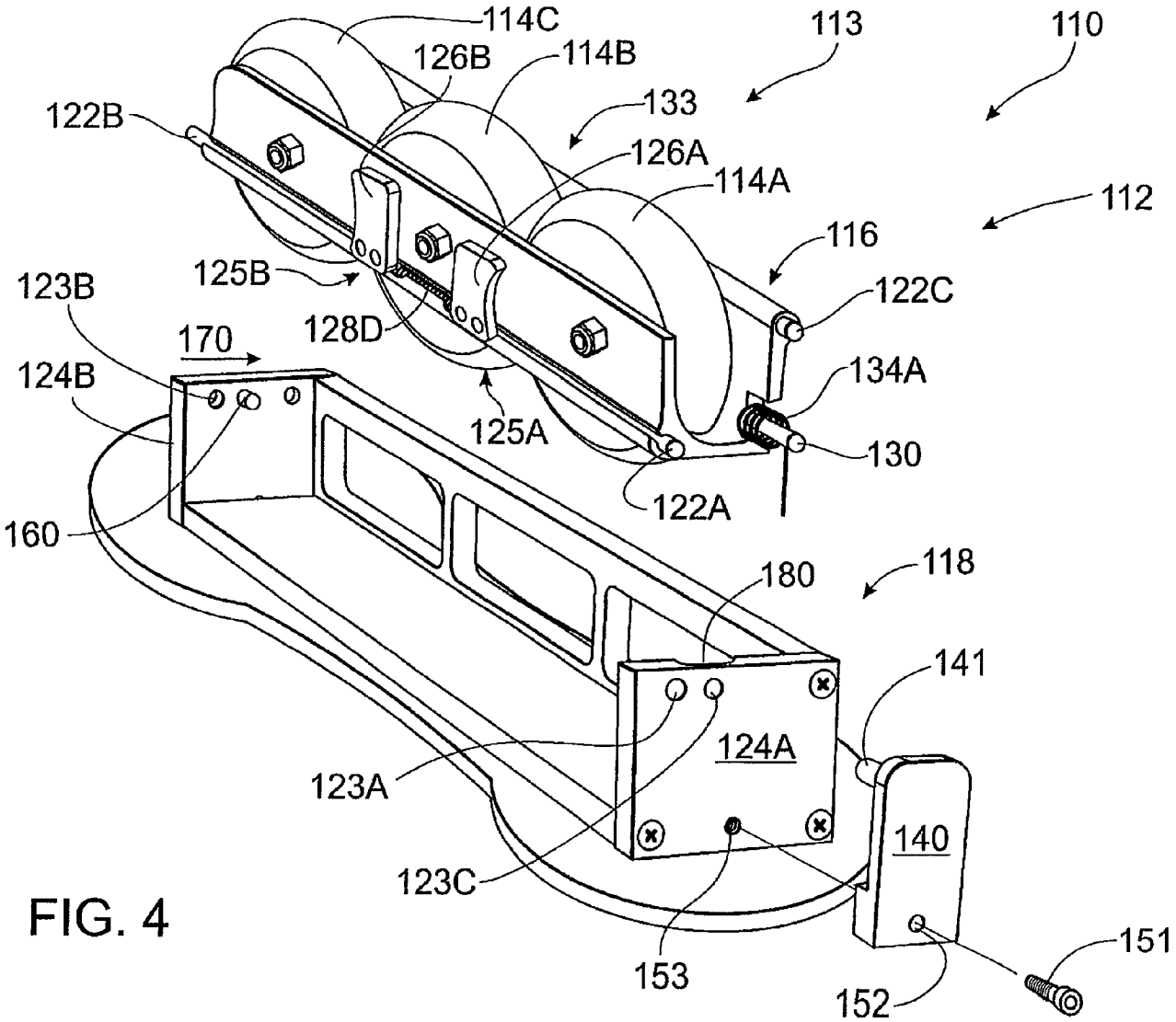
FIG. 4 shows a perspective view of an embodiment of the displacement apparatus bracket having a button to initiate retraction of the skating means.
Figure 5:
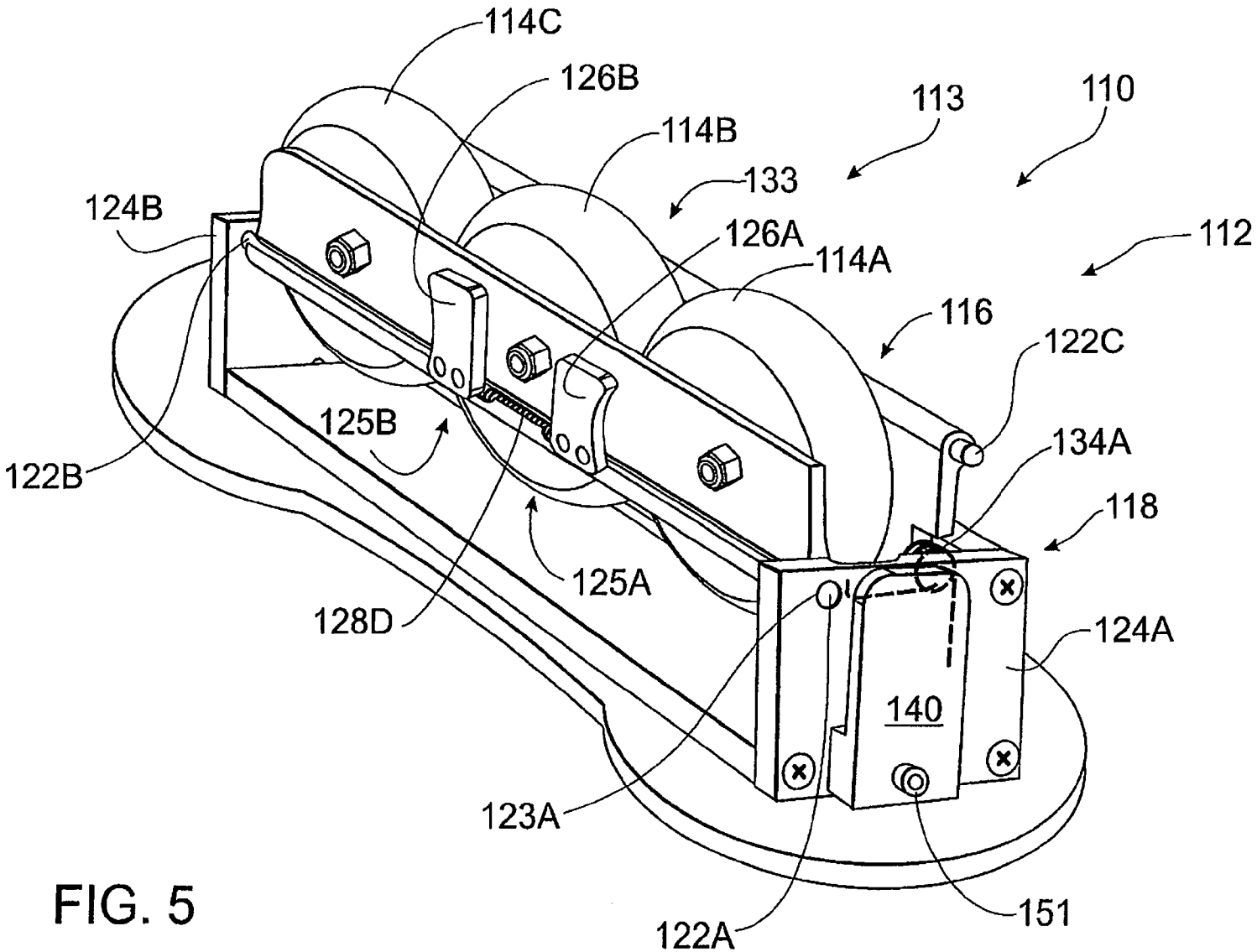
FIG. 5 shows another a perspective view of an embodiment of the displacement apparatus bracket having a button to initiate retraction of the skating means.

Referring now to FIGS. 4 and 5, there is shown an embodiment of displacement apparatus 112 of skating footwear 110 having actuating means 133 comprising button 140 mounted to bracket 118, which button 140 is manually operable to assist initiating extension of skating means 113 comprising three in-line wheels 114A, B and C. Actuating means 133 also comprises respective first and second retraction triggers 125A, 125B which are manually operable by respective tabs 126A, 126B.

When manually pushed into aperture 123C, projection 141 on button 140 displaces rod 122C out of aperture 123C and thereby disengages third rod 122C from third aperture 123C to facilitate extension of displacement apparatus 112. Button 140 may be mounted to bracket 118 by way of screw 151 engaging threaded apertures 152 and 153 or by any equivalent means such as rivets or the like. Extension of skating means 113 is assisted by hairpin springs 134A, 134B (See FIG. 1).

Also shown in FIG. 4 is lug 160 that bears against carriage 116 to limit unwanted movement of carriage 116 and skating means 113 in the direction of arrow 170 when in an extended position.

Furthermore, referring particularly to the embodiment in FIG. 5, first rod 122A and second rod 122B are opposably slidable against intermediate spring 128D which acts to retain first rod 122A and second rod 122B in respective first and second apertures 123B.

It is also noted that in order to assist passage of first rod 122A and third rod 122C past end plate 124A and into aperture 123C during retraction, lead-in 180 is provided in end plate 124A.

It will be generally appreciated that the present invention is susceptible to modification and variation while staying within the broad spirit and scope of the invention. For example, the number of retraction and extension triggers, the number of rods and respective apertures can be varied, as can the location of rods and apertures in carriage and bracket respectively.

In light of the foregoing, the present invention provides pivotal displacement of said skating means by way of a relatively simple, efficient and easy to use apparatus readily adaptable to any kind of skating footwear, and which allows rapid interconversion of such footwear between walking use and skating use.

In particular, the present invention provides a displacement apparatus that allows optimal clearance between skating shoe and ground when extended, while allowing complete retraction of the wheels or skates into the shoe underside. Furthermore, the displacement apparatus of the present invention is less prone to accidental or unintentional movement from a extended position to a retracted position and vice versa.

It should also be understood that the invention is not limited to the particular combination of features described in detail herein, and that various modifications and departures may be made which nevertheless fall within the broad scope of the invention as set forth herein.

The invention claimed is:

1. A displacement apparatus for footwear having a skating means, said displacement apparatus comprising a mounting bracket and an actuating means operable to initiate pivotal displacement of said skating means, wherein said skating actuating means comprises one or more retraction triggers, each of which is connected to one or more respective rod members that releasably engage respective apertures in said mounting bracket to thereby retain said skating means in an extended position; and one or more extension triggers, each of which is connected to one or more respective rod members that releasably engage respective apertures in said mounting bracket to thereby retain said skating means in a retracted position.

2. The displacement apparatus of claim 1, comprising first and second retraction triggers respectively connected to first and second slidable rod members.

3. The displacement apparatus of claim 2, wherein said first and second slidable rod members are releasably engageable with said respective apertures.

4. The displacement apparatus of claim 3, wherein said retraction triggers are each manually operable to disengage said slidable rod members from said respective apertures and thereby initiate retraction of said skating means.

5. The displacement apparatus of claim 2, wherein said first and second rod members are opposably slidable.

6. The displacement apparatus of claim 1, comprising a single extension trigger connected to a slidable rod member which, when said skating means is in a retracted position, releasable engages said aperture in said displacement apparatus.

7. The displacement apparatus of claim 6, wherein said extension trigger is manually operable to disengage said slidable rod member from said aperture to thereby initiate extension of said skating means.

8. The displacement apparatus of claim 7, wherein said extension trigger includes a manually operable button comprising a projection that is operable to disengage said slidable rod member from said aperture.

9. A displacement apparatus for footwear having a skating means, said displacement apparatus comprising a bracket mountable to an underside of said footwear which comprises first, second, and third apertures and an actuating means operable to initiate pivotal displacement of said skating means, wherein said actuating means comprises first and second retraction triggers respectively connected to first and second slidable rod members which, when said skating means is in an extended position, respectively releasably engage said first and second apertures in said bracket and are each manually operable to disengage said first and second slidable rod members from said respective apertures to thereby initiate retraction of said skating means; and an extension trigger connected to a third slidable rod member which, when said skating means is in a retracted position, releasably engages said third aperture in said bracket; said extension trigger including a manually operable button comprising a projection that is operable to disengage said third slidable rod member from said third aperture to thereby initiate extension of said skating means.

10. A displacement apparatus mounted to an in-line roller shoe, said displacement apparatus comprising a mounting bracket mounted to an underside of said roller shoe which comprises first, second and third apertures; and an actuating means operable to initiate pivotal displacement of in-line wheels, wherein said actuating means comprises first and second retraction triggers respectively connected to first and second slidable rod members which, when said in-line wheels are in an extended position, respectively releasably engage said first and second apertures in said bracket and are each manually operable to disengage said first and second slidable rod members from said respective apertures to thereby initiate retraction of said skating means; and an extension trigger connected to a third slidable rod member which, when said in-line wheels are in a retracted position, releasably engages said third aperture in said bracket; said extension trigger including a manually operable button comprising a projection that is operable to disengage said third slidable rod member from said third aperture to thereby initiate extension of said skating means.

11. Skating footwear comprising the displacement apparatus of either claim 1 or claim 9.

12. Skating footwear of claim 11, whereby the skating means comprises three, in line wheels.

13. Skating footwear of claim 12, wherein said skating means is housed substantially within the underside of said footwear when retracted.

* * * * *